United States Patent [19]

Koizumi et al.

[11] Patent Number: 4,479,061

[45] Date of Patent: Oct. 23, 1984

[54] LUMINANCE AMPLIFIER AND AN APPARATUS INCLUDING THE SAME

[75] Inventors: Yuichiro Koizumi; Toshie Kaneko, both of Yokohama, Japan

[73] Assignee: Canon Kabushiki Kaisha, Tokyo, Japan

[21] Appl. No.: 589,057

[22] Filed: Mar. 15, 1984

Related U.S. Application Data

[63] Continuation of Ser. No. 283,912, Jul. 16, 1981, abandoned.

[30] Foreign Application Priority Data

| | | | |
|---|---|---|---|
| Jul. 25, 1980 | [JP] | Japan | 55-101913 |
| Feb. 27, 1981 | [JP] | Japan | 56-27755 |
| Feb. 27, 1981 | [JP] | Japan | 56-27756 |

[51] Int. Cl.[3] ..... H01J 1/62

[52] U.S. Cl. ..... 250/487.1; 250/433.1

[58] Field of Search ..... 250/283.1, 286.1, 287.1

[56] References Cited

U.S. PATENT DOCUMENTS

| | | | |
|---|---|---|---|
| 3,280,358 | 10/1966 | Thompson | 250/487.1 |
| 3,783,299 | 1/1974 | Houston | 250/483.1 |
| 3,936,645 | 2/1976 | Iversen | 250/486.1 |
| 3,944,835 | 3/1976 | Vosburgh | 250/487.1 |
| 4,209,705 | 6/1980 | Washida et al. | 250/486.1 |
| 4,398,118 | 8/1983 | Galues et al. | 250/483.1 |

*Primary Examiner*—Bruce C. Anderson

*Attorney, Agent, or Firm*—Fitzpatrick, Cella, Harper & Scinto

[57] ABSTRACT

A luminance amplifier comprises excitative irradiation generating device for exciting a fluorescent body which extends continuously or discontinuously, a plate carrying said fluorecent body and a grating disposed intimately close to said plate and including a plurality of minute cells which are provided with light-diffusive walls. The minute cells are adapted to amplify the luminance in the irradiant area on the fluorescent body which is excited by the excitative irradiation.

21 Claims, 15 Drawing Figures

LUMINANCE AMPLIFIER AND AN APPARATUS INCLUDING THE SAME

This application is a continuation of application Ser. No. 283,912 filed July 16, 1981, now abandoned.

BACKGROUND OF THE INVENTION

1. Field of the Invention

This invention relates to an apparatus for amplifying luminance on the surface of an illuminant and also concerns an apparatus for improving brightness in images looked at through X-ray examination apparatuses, images indicated on TV Braun tubes and discharge type display panels, or symbols indicated on display panels by light emitting diodes.

2. Description of the Prior Art

In the prior art indirect X-ray photographing apparatuses for medical services, the X-rays transmitted through a human body are imaged on a fluorescent screen as a visible image which is in turn photographed. Recently, there is stricter standards about X-ray irradiation doses which remarkably restrict X-ray irradiation for human bodies. If the X-ray irradiation is decreased, brightness in images formed on a fluorescent screen would be reduced. This leads to such a problem that it is difficult to make a diagnosis based on X-ray photographs. On the contrary, if the image brightness is increased by changing the construction of the fluorescent screen so as to overcome such a problem, the resolving power would be reduced. It is therefore desired that the image brightness is increased without any reduction in resolving power.

On the other hand, there is a remarkably large advance in the field of discharge type plane display panels as in wall type television receivers. Such plane display panels comprise a matrix which is provided with a substrate including dotted fluorescent layers disposed thereon corresponding to R.G.B. and ultraviolet illuminant elements located behind the substrate for illuminating the respective separated dots. There is presently a problem in that the luminance in each dot is in low level. It is difficult to increase the luminance under various limitations as in construction of the illuminant element matrix.

It is also desired that electric power is less consumed in the field of LED displaying devices which can be used in small-sized electronic computers. However, if the electric supply is simply decreased, the brightness in displays would be reduced resulting in another problem.

SUMMARY OF THE INVENTION

It is an object of this invention to amplify the luminance in an illuminant including continuous or discontinuous light-emitting section in a predetermined direction.

Another object is to effectively utilize the luminous light from a fluorescent substrate which is excited by an excitative irradiation.

Still another object is to provide an apparatus for forming images on a fluorescent screen, in which the brightness in the formed images can be increased.

Further object is to provide an apparatus for displaying images on two-dimensional array of minute fluorescent bodies, in which the brightness in the formed images can be increased.

Still further object is to provide an apparatus for displaying patterns on two-dimensional array of minute fluorescent bodies, in which the brightness in the patterns can be increased.

Further object is to decrease X-ray irradiation on a fluorescent screen.

Further object is to reduce such an electric power that is consumed for displaying images.

DESCRIPTION OF THE PREFERRED EMBODIMENTS

Figure 1:
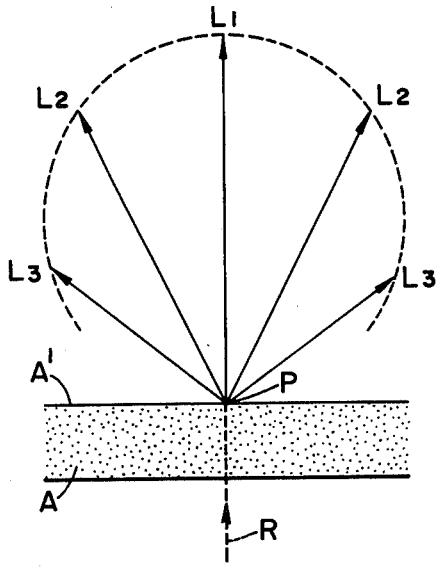
FIG. 1 is a view illustrating fluorescent radiations.

FIG. 1 illustrates visible light rays radiated from a point P as a fluorescent plate A is irradiated by an excitative radiation R such as X-ray or ultraviolet ray. The visible rays are diverged in all the directions $L_1$, $L_2$ and $L_3$ under the influence of the microscopic irregularity on the surface A′ of the fluorescent plate and also under the diffusion in the fluorescent plate so that the quantity of light entering observer's eyes will be reduced.

Figure 2:
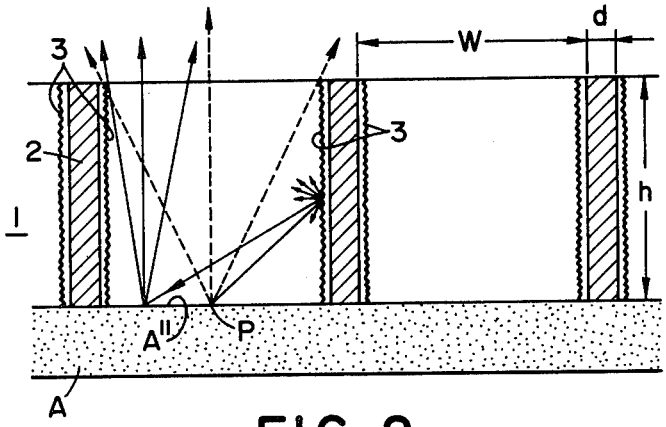
FIG. 2 is a cross-sectional view of an embodiment according to this invention.
Figure 3:
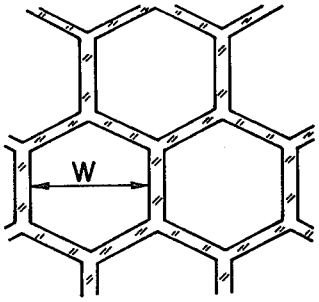
FIGS. 3 and 4 are plan views showing major sections of embodiments according to this invention.
Figure 10:
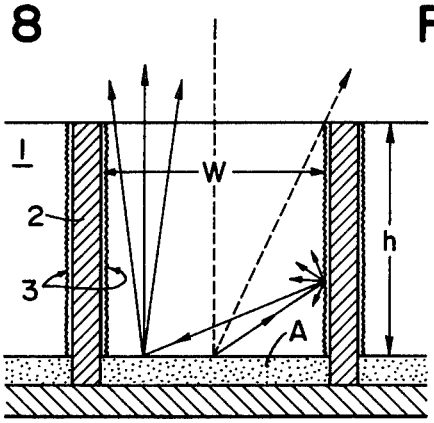
FIG. 10 is a cross-sectional view of another embodiment according to this invention.

FIGS. 2 and 10 show a cross-section of a reticulated grating in an embodiment according to this invention. This grating has, for example, hexagonal repeated patterns as shown by a top view in FIG. 3. In FIGS. 2 and 10, reference numeral 1 designates a reticulated grating which is constructed of regularly connected walls 2. Each of the walls 2 is coated with white-colored paint layers 3 for increasing the diffusion thereon. An example of one reticulation dimension includes the distance w between the opposed walls of 0.66 mm, the wall thickness d of 0.07 mm and the height (depth) h of 0.63 mm. The distance w and height h have dimensions in the order less than 1.0 mm but not less than 0.1 mm.

The grating can be made by such a process that comprises the steps of exposing a photosensitive sheet glass to light through a mask having a minute grating pattern, heat-treating the exposed sheet glass for subjecting to the primary crystallization, etching the heat-treated sheet glass to remove unnecessary portions and then coating the inner walls of the grating with a white-colored pigment such as magnesium powder, barium sulfate or the like. Alternatively, the heat-treated sheet glass can be subjected to the second heat-treatment for secondary crystallization after the etching steps so that the inner walls will have their light-diffusible surfaces.

An example of the heat treatments for secondary crystallizing a photosensitive sheet glass will now be described. For example, the photosensitive sheet glass is suitably chemically cuttable. More concretely, it is suitable to use a photosensitive opal glass containing lithium, which contains 84% or more of major ingredients, 70–80% of $SiO_2$, 9–15% of $Li_2O$ and 0–8% of $Na_2O$ or $K_2O$. In addition, it contains 0–0.05% of $CeO_2$, 0–10% of $Al_2O_3$ and one selected from a group consisting of 0.001–0.03% of Au, 0.001–0.3% of AgCl and 0.001–1% of $Cu_2O$. Such a photosensitive sheet glass is irradiated by ultraviolet rays through an exposure mask having a predetermined pattern and then heated (that is, heat-treated for primary crystallization) to cause crystalline $LiO_2.SiO_2$ to separate out at the irradiated areas. The $LiO_2.SiO_2$ crystal is easily dissolved in dilute hydrofluoric solution (2–10%). Therefore, only the irradiated material on the glass can selectively be removed when it is dipped in the hydrofluoric solution.

When the so obtained grating is re-heated (that is, heat-treated for secondary crystallization) at an elevated temperature higher than that of the heat treatment for primary crystallization, the $LiO_2.SiO_2$ crystal is changed to $LiO_2.2SiO_2$ crystal which is in the form of a white-colored crystal for providing a light-diffusion property. After the heat treatment for secondary crystallization, the inner walls of the grating may be coated with a white-colored pigment for increasing the light-diffusion property thereof.

The so processed photosensitive glass shows the following values in total diffusion reflection factor relative to various wavelengths of light:

| Wavelength (nm) | Total Diffusion Reflection Factor (%) |
|---|---|
| 400 | 67 |
| 450 | 66 |
| 500 | 64.7 |
| 550 | 63.7 |
| 600 | 63.1 |
| 650 | 62.5 |
| 700 | 62.2 |

The photosensitive sheet glass may be replaced by any suitable sheet metal such as aluminium, steel and the like. Such a sheet metal is formed with openings as by use of photoetching, electron beam, laser or the like, and then covered at its inner walls with reflective layers for providing a light-diffusion property.

The reticulated grating 1 is placed on a fluorescent plate A made of, for example, sulfide and preferably adhesively bonded thereto. Optical action will now described with respect to FIG. 2. A portion of light beam emitted from the point P directly enters a photographing system or observer's eyes without being intercepted by the walls of the grating. The remaining light beam portion, which deviates more broadly out of the optical axis, is incident on the grating walls and then diffused by the diffusible coating layers 3 thereon. It is believed that a portion of the diffused light is reflected by the surface A″ of the fluorescent plate surrounded by the inner walls of the grating and further by the coating layers 3 with the reflections being repeated. As a result, the total quantity of light is increased in the direction of the optical axis. In this connection, it is important that the coating layers 3 should provide the diffusible property if the inner walls are flat. That reason is that experiments utilizing reticulated gratings with more reflective walls, for example, with aluminium-deposited walls show reduced luminance in comparison with the reticulated grating having white-colored diffusion layers. Furthermore, an advantage of this invention has been proved by the fact that when the reticulated grating 1 of this invention is placed on a portion of the fluorescent plate A which is in turn irradiated backward by X-rays to photograph a visible image converted by the fluorescent plate, the photographed portion of the negative film in the form of grating is more darkened than the surrounding portions. When the grating and non-grating portions of the negative film were scanned by a microphotometer with a spot of $25\times25$ $\mu$m in size, the ratio in density therebetween was 1:2.5 for a hexagonally reticulated grating having the aforementioned data. This means that the luminance is increased 2.5 times.

An effect due to the height (or depth) h among the structural requirements in the reticulated grating of this invention will now be explained. It is desirable that the light portion of the beam emitted from the illuminant surface which enters the photographing lens or the observer's eyes is in the range of a predetermined solid angle. Accordingly, the height h in the grating associated with the illuminant must be such a range that this light beam portion will not be intercepted. In a view point that the grating is prepared, it is convenient that the grating is more decreased in height. On the other hand, if the height is too decreased, the amplifying effect would not be produced sufficiently. The following table shows results in experiments when values of the distance w between the inner walls in the grating divided into the height h thereof were changed:

| h/w | 0.75 | 1.0 | 1.5 |
|---|---|---|---|
| Amplification | 2.3 times | 2.5 times | 2.5 times |

It is understood from the above table that the luminance can be sufficiently amplified if the ratio of the height h to the wall distance w is in the order of 1.0.Even if this ratio is in the order of 0.75, a substantially satisfactory amplification can be obtained. On the contrary, even if the ratio is established at 1.5, the amplification will not be further increased. Rather, the last-mentioned case may probably cause the inner walls of the grating to intercept the effective light beams in the range of a predetermined solid angle. If the ratio h/w is about 1.0, however, a visual field will not intercepted within the general viewing scope even in directions slanted apart from the optical axis. Thus, the walls in the grating will function as a certain secondary source of light in such a manner that the grating becomes more inconspicuous. Even where images are photographed through a photographing lens, the effective light beams will not be intercepted by the grating.

Figure 4:
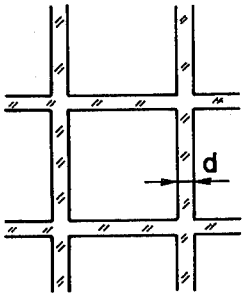

The reticulated grating is not limited in its shape to the hexagonal configuration and may be formed in such a square configuration as shown in FIG. 4, for example.

Figure 5:
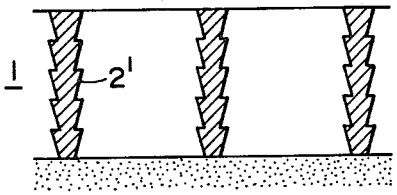
FIG. 5 is a view of a modification in this invention.

It is however desirable that the thickness in the walls of the grating is selected as small as possible since the area occupied by the walls in the grating does not provide any contribution with respect to the amplification in luminance.

Where diffusive reflection walls deposited with aluminium are used in place of the walls having flat paint-coated faces, similar amplification can be obtained if these walls are formed to provide such a configuration that the light from the fluorescent plate can be reflected to return to the same. An example of such a configuration is shown in FIG. 5.

Figure 6:
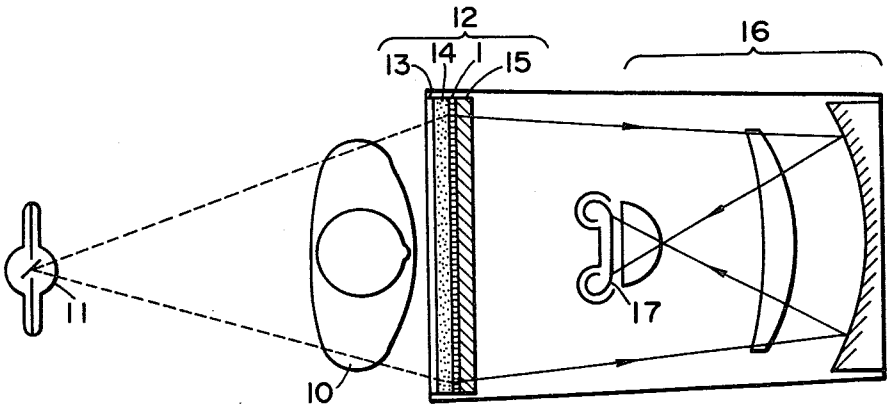
FIG. 6 is a view of an example in which the embodiment of FIG. 2 is applied to an indirect X-ray photographing apparatus.

FIG. 6 shows an example of the reticulated grating 1 according to this invention which is applied to an indirect X-ray photographing machine as used in a group examination for chest and stomach. In this figure, reference numerals 10 and 11 designate a person to be examined and an X-ray tube, respectively. Reference numeral 12 denotes a panel for converting an X-ray image to a visible image, in which an X-ray grid 13, a fluorescent plate 14, the reticulated grating 1 and a lead-containing sheet glass 15 are progressively arranged and supported integral to each other in a direction beginning at the X-ray grid and going away from the person to be examined. In FIG. 6, all the components in this panel are exaggerated in thickness. FIG. 6 further shows a reflection type photographing lens 16 and a photographing film 17.

When the X-ray tube 11 is energized, X-ray is transmitted therefrom through the person to be examined 10 to the fluorescent plate 14 at which a negative image is formed. Fluorescent light emitted from the plate 14 is amplified by the reticulated grating 1 and then reflected and refracted by the photographing lens 16 to image it on the photographing film 17. According to this invention, the grating 1 is disposed intimately close to the irradiant surface of the fluorescent plate 14 so that the light incident on the photographing lens 16 from the fluorescent plate 14 will be increased in quantity in comparison with no grating as the reticulated grating 1. Accordingly, the image formed on the film will be improved in darkness.

Ultimately, if it is wanted to form an image on the film with the same darkness as in negative images formed through no grating according to this invention, the irradiation for the same purpose may be reduced to decrease the adverse effects of the radiation to human bodies.

It is however noted that the image on the fluorescent plate is constituted of a plurality of image elements divided by the reticulated grating 1. The image is restricted in quality by the mesh size of the grating. It is therefore important that the grating has its mesh size as small as possible for obtaining images having higher quality.

Figure 7:
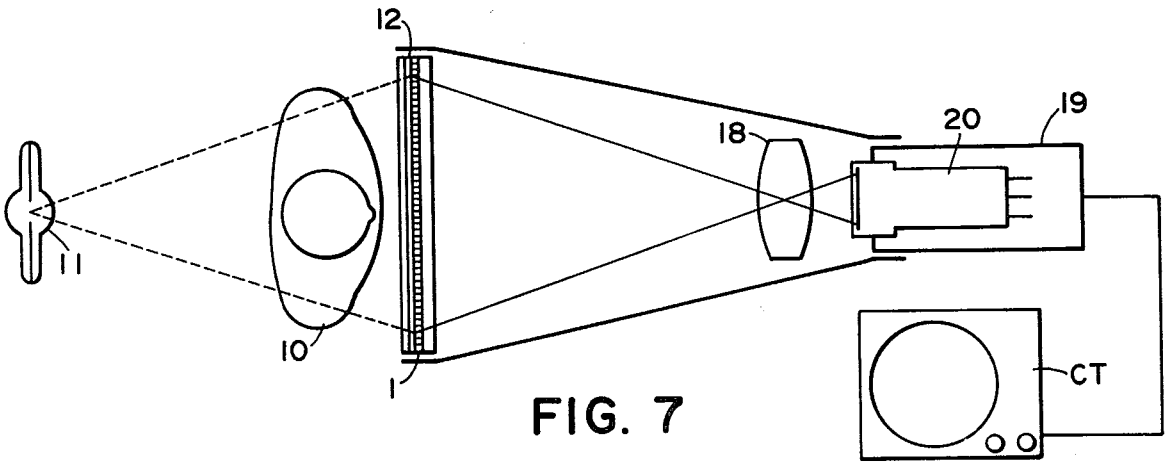
FIG. 7 is a view of an example in which the embodiment of FIG. 2 is applied to an X-ray fluoroscoping and observing apparatus.

FIG. 7 shows an X-ray fluoroscoping apparatus which comprises an imaging lens 18, a TV camera 19, a pickup tube 20 located within the camera and a TV receiver CT. In a manner similar to that in FIG. 6, a fluorescent negative image is formed on the converting panel 12 after being amplified in luminance. This negative image is imaged on the taking surface of the pickup tube 20 through the imaging lens 18 and then visualized at the TV receiver CT connected with the TV camera 19. Similarly, the X-ray irradiation may be reduced depending upon the degree of sensitivity improved by the reticulated grating according to this invention. In group examinations for stomach and others which are broadly carried out, therefore, the fluoroscoping X-ray irradiation for confirming a position to be photographed may be reduced to avoid any adverse effects to human bodies. This is also desirable in view of hereditary transmission.

This invention can be also applied to a panel for converting X-ray images to visual images which can be observed directly by a medical doctor, in addition to the X-ray fluoroscoping apparatus having TV receiver as abovementioned. In such an application, there is used an integral conversion panel including a grid, a fluorescent plate, a reticulated grating and a lead-containing sheet glass all of which are arranged one adjacent to another in order from an X-ray tube. Such a panel is positioned between a person to be examined and an operator who observes the fluorescent image of, for example, the chest while pressing it as required.

Figure 8:
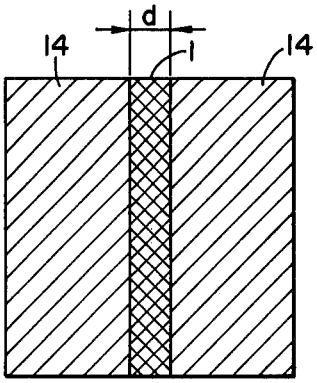
FIG. 8 is a plan view showing a plate for converting an X-ray image to a visible image.
Figure 9:
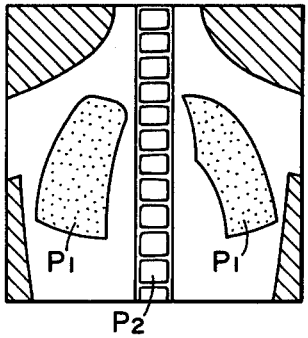
FIG. 9 is a view showing an example of X-ray chest photographs.

When it is wanted to photograph the chest of a person to be examined, his spine cannot be substantially taken by such an X-ray irradiation as causing his lungs to be exposed in an optimum state because the spine is different from the lungs in X-ray absorption factor. It is however convenient that the spine can be taken since its bend is readily discovered if present. FIG. 8 shows a reticulated grating 1 of a width d which is disposed between two fluorescent plates 14. The width d is selected depending on the average width in spines of children. By using such a fluorescent plate assembly, a photograph as shown in FIG. 9 is taken, in which lungs $P_1$ and spine $P_2$ are simultaneously photographed. If any bend is present in the spine, it can be readily discovered since the bend is positioned out of the central strip-like zone in the photograph.

Figure 11:
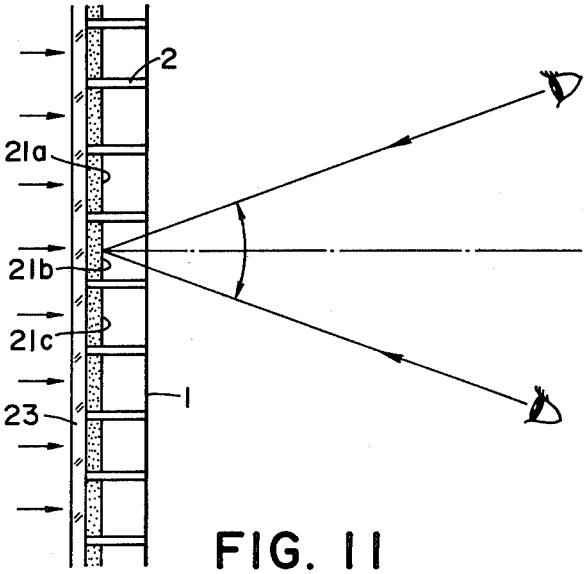
FIG. 11 is a view showing an example in which the embodiment of FIG. 10 is applied to a discharge type display panel.

FIG. 11 shows a reticulated grating 1 according to this invention which is mounted on a discharge type plane display panel. This embodiment is illustrated to omit an ultraviolet-ray illuminant element matrix for irradiating a plurality of dotted fluorescent layers, drive electrodes and others which have been already known in Japanese Patent Disclosure No. Sho. 49-79627 and others. The panel comprises dotted fluorescent layers 21*a*, 21*b* and 21*c* for red-, green- and blue-colors, respectively which are disposed on a transparent substrate 23 and can be independently irradiated backward by ultraviolet rays emitted from the respective ultraviolet-ray irradiating elements. Each of the irradiated fluorescent layers emits a visible ray of the corresponding red-, green-, or blue-color. In the same manner as described in reference to FIG. 2, these visible rays are directed to the observer's eyes after being amplified at the walls of the grating 1. Consequently, the observer will see a group of fine fluorescent layers through the grating as a colored image. This colored image is increased in brightness since the luminance of each of the fluorescent rays from the individual dotted fluorescent layers is amplified by the grating. In FIG. 11, the sizes in the fluorescent layers and grating are exaggerated for clarification.

In the embodiment shown in FIG. 11, each of the fluorescent layers is inserted into the bottom of the corresponding mesh in the grating. Alternatively, the grating may be mounted on the substrate in such a manner that each of the fluorescent layers thereon will be exactly aligned with one mesh in the grating. The fluorescent substrate and grating must be housed within a vacuum vessel. It is therefore required that the grating is made of any suitable nonvolatile material such as metals, photosensitive glass, resins and others. If any resin is used, however, it is required to cover the surface thereof with a nonvolatile glass material as by vapor-deposition and also to provide diffusely reflective layers on the walls of a grating made of such a material.

Figure 12:
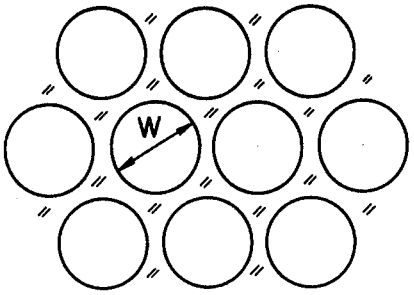
FIG. 12 is a plan view showing the grating in the embodiment of FIG. 10.

The mesh size w in the grating (FIG. 12) is roughly restricted depending upon the size of the assembled illuminant. In the discharge type plane display panel shown in FIG. 11, the size of each of the dotted fluorescent layers is determined depending upon the necessary resolving power with respect to an image formed by the fluorescent layers each of which serves as an image element. Accordingly, the grating associated with these fluorescent layers is selected in size in line with the size in the latter.

Figure 13:
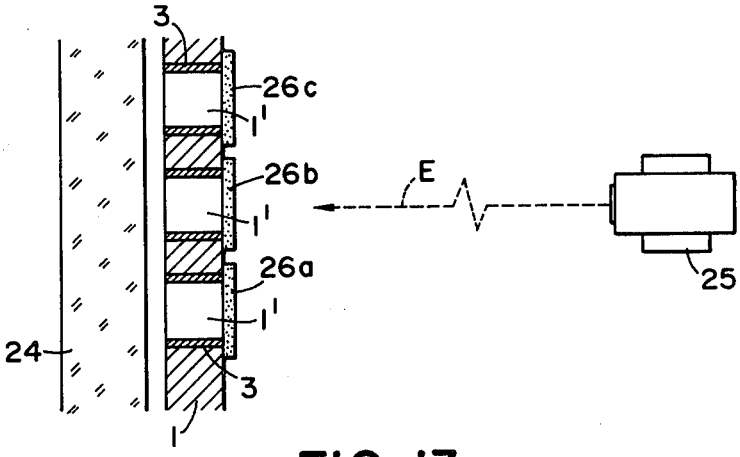
FIG. 13 is a view of an example in which this invention is applied to a Braun tube.

FIG. 13 shows an embodiment of this invention which is applied to the Braun tube in a color television. In this figure, reference numeral 24 designates a face plate for maintaining the Braun tube casing at vacuum, and reference numeral 25 denotes an electron gun for operating an electron beam E in response to video signals. Further, reference numeral 1 designates a reticulated grating which is provided with a plurality of very minute apertures 1' with their inner walls being covered with light-diffusion layers 3. The grating 1 is bounded or located close to the face plate. There are also dotted fluorescent bodies 26*a*, 26*b* and 26*c* which correspond to three primary colors. These components are exaggeratedly shown for clarification.

The fluorescent bodies 26*a*, 26*b* and 26*c* each constituting an image element are applied or bonded as by adhesive to the grating 1 at positions corresponding to the respective apertures 1'. If the Braun tube used is in the form of a shadow-mask type color Braun tube, a shadow mask is located on the right-hand side of the fluorescent bodies, and the apertures are of a circle-shape. In a slit mask, however, the apertures are of an oval-shape.

In such an arrangement, as the electron beam E is incident on one of the fluorescent bodies 26*a*, 26*b* and 26*c*, that fluorescent body is excited to produce a visible ray. As described with respect to FIG. 10, the image can be increased in brightness since the luminance in the fluorescent bodies is amplified.

Figure 14:
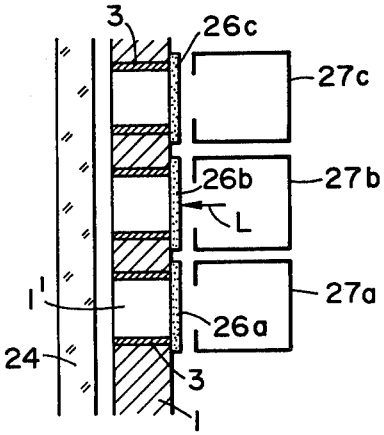
FIG. 14 is a view of another example in which this invention is applied to a discharge type display panel.

FIG. 14 is a schematic view showing an embodiment of this invention which is applied to a discharge type panel display In this figure, similar parts are designated by similar reference numerals. New reference numerals 27*a*, 27*b* and 27*c* denote ultraviolet-ray emitting cells each of which is located opposed to the corresponding one of the fluorescent bodies 26*a*, 26*b* and 26*c*. As aforementioned, each of the fluorescent bodies constitutes an image element. When each of the fluorescent bodies is excited by an ultraviolet ray L, a visible ray is generated therefrom. The luminance in that fluorescent body can be amplified since a portion of the above visible ray radiated toward the walls of the grating is also effectively utilized.

A process in which the fluorescent bodies are applied to the grating 1 will now be described. It is difficult to apply the fluorescent bodies 26*a*, 26*b* and 26*c* directly over the apertures 1' as shown in FIG. 13. In order to overcome this problem, silicon rubber material is charged into the apertures 1' from the left-hand side of the grating 1 to form a continuous sheet of the same material at the leftside wall of the grating 1 and end faces of the same material which are flush with the rightside wall of the grating at the right-hand or exit ends of the apertures. Thereafter, the fluorescent bodies 26*a*, 26*b* and 26*c* are applied to the grating 1 to cover the end faces of the material as by slurry method. Finally, the silicon rubber material is released from the grating. This process is easily accomplished since the silicon rubber material is superior in release characteristics. Alternatively, such a material as paraffin, thermoplastic resin or the like may be charged into the apertures 1', melted by heat and removed therefrom after the fluorescent bodies have been applied.

Furthermore, the apertures 1' can be filled with any suitable transparent material that transmits visible rays.

It is of course true that after or before the fluorescent bodies are applied to the grating, the properties thereof can be improved by use of such black-matrix treatment and metal backing that have been generally carried out.

Figure 15:
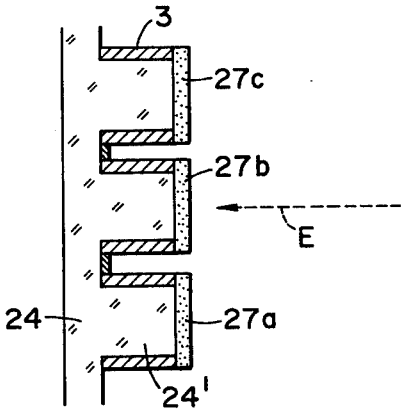
FIG. 15 is a view showing an example in which the major portion of the construction shown in FIG. 13 is modified.

FIG. 15 shows a modification of the structure shown in FIG. 13. In FIG. 15, transparent bodies 24' correspond to the apertures 1' in FIG. 13. The side walls of the bodies 24' are covered with diffusely reflective layers 3 each of which is adapted to scatter or diffusely reflect the light from the corresponding one of fluorescent bodies 27*a*, 27*b* and 27*c* which irradiate when they are excited as by an electron beam.

While not illustrated, the grating 1 is of a spherical shape as in the face plate 24 if this modification is applied to an image receiving tube of Braun tube type.

The grating according to this invention may be assembled with display panels including LED or the like to improve the irradiation luminance for facilitating the reading of the displayed letters and others. If the luminance is sufficiently amplified, any input energy for irradiation can be reduced. In this case, it is possible, for example, to associate the meshes of the grating with the respective segments in the letter unit.

What we claim is:

1. A luminance amplifying apparatus comprising:

irradiating means for radiating through a luminant surface to the outside, wherein the luminant surface reflects radiation incident thereon from the outside; and a grating disposed adjacent to the luminant surface and outside said irradiating means and including a plurality of walls which reflect and diffuse radiation and which define apertures;

whereby radiation emitted by said irradiating means is reflected by said walls and by the luminant surface so as to increase the luminance along the normal to the luminant surface.

2. A luminance amplifying apparatus as defined in claim 1 wherein a ratio of the height h of said grating to the distance w between the opposed walls of one aperture in said grating is in the range of 0.75 to 1.5.

3. A luminance amplifying apparatus as defined in claim 1 wherein the thickness h of said grating is in the order of 0.1 mm.

4. A luminance amplifying apparatus as defined in claim 1 wherein said walls include a white-colored pigment.

5. A luminance amplifying apparatus as defined in claim 1 wherein said irradiating means is in the form of a plate which is made of a fluorescent material.

6. A luminance amplifying apparatus as defined in claim 1 wherein said irradiating means is in the form of an array which is constituted of fluorescent material fragments.

7. An image displaying apparatus comprising:

a fluorescent plate having layers which are made of a fluorescent material for radiating through an emitting surface to the outside, wherein the emitting surface reflects radiation incident thereon from the outside;

excitative irradiation-generating means disposed at a side of said fluorescent plate opposite to the side having the emitting surface for exciting said fluorescent plate; and amplifying means disposed adjacent to the emitting surface and outside said fluoresecent plate and having a plurality of cells defined by walls which reflect and diffuse radiation;

whereby radiation emitted by said fluorescent plate is reflected by said walls and by the emitting surface so as to increase the luminance along the normal to the emitting surface.

8. An image displaying apparatus as defined in claim 7 wherein the height h in said cells is in the order of 0.1 mm.

9. An image amplifying apparatus as defined in claim 7 wherein said excitative irradiation is X-ray.

10. An image displaying apparatus as defined in claim 7 further including means for photographing said fluorescent plate through said amplifying means.

11. An image displaying apparatus as defined in claim 7 further including video camera means for taking said fluorescent plate through said amplifying means and video display means electrically connected with said video camera.

12. An image displaying apparatus as defined in claim 7 wherein said amplifying means is of a strip-shape that extends vertically at the center of said fluorescent plate.

13. An image displaying apparatus comprisng:

an array constituted of a plurality of fluorescent material fragments which are arranged two-dimensionally for radiating through an emitting surface to the outside, wherein the emitting surface reflects radiation incident thereon from the outside;

exciting means disposed at a side of said array opposite to the side having the emitting surface for exciting said fragments; and amplifying means disposed adjacent to the emitting surface and outside said array and having a plurality of cells which are defined by walls which reflect and diffuse radiation;

whereby radiation emitted by said fluorescent material fragments is reflected by said walls and by the emitting surface so as to increase the luminance along the normal to the emitting surface.

14. An image displaying apparatus as defined in claim 13 wherein said exciting means is in the form of a matrix on which are two-dimensionally arranged a plurality of elements for emitting ultraviolet rays independently in response to video information.

15. An image displaying apparatus as defined in claim 13 wherein each of said fragments is located opposed to one of said cells.

16. An image displaying apparatus as defined in claim 13 wherein said exciting means is in the form of a TV electron gun.

17. An image displaying apparatus as defined in claim 13 further including a casing for maintaining said array, exciting means and amplifying means in vacuum.

18. An image displaying apparatus comprising:

an array including a plurality of fluorescent material fragments which are two-dimensionally arranged therein for radiating through an emitting surface to the outside, wherein the emitting surface reflects radiation incident thereon from the outside;

a matrix disposed at a side of said array opposite to the side having the emitting surface on which matrix are two-dimensionally arranged a plurality of excitative elements for exciting said fragments, respectively; and a grating disposed adjacent to the emitting surface and outside said array and including a plurality of cells each of which is opposed to the corresponding one of said fragments and which are defined by walls which reflect and diffuse radiation;

whereby radiation emitted by said fluorescent material fragments is reflected by said walls and by the emitting surface so as to increase the luminance along the normal to the emitting surface.

19. An image displaying apparatus as defined in claim 18 wherein each of said exciting elements is in the form of a cell for emitting an ultraviolet ray.

20. An image displaying apparatus as defined in claim 18 further including a transparent face-plate disposed in front of said grating.

21. An image displaying apparatus as defined in claim 7, wherein said amplifying means extends over at least a part of said fluorescent plate.

* * * * *

UNITED STATES PATENT AND TRADEMARK OFFICE

CERTIFICATE OF CORRECTION

PATENT NO. : 4,479,061

DATED : October 23, 1984

INVENTOR(S) : YUICHIRO KOIZUMI, ET AL.

It is certified that error appears in the above-identified patent and that said Letters Patent is hereby corrected as shown below:

Column 3, line 60, after "now" insert --be--.

Column 4, line 58, insert --be-- after "not".

Column 5, line 46, after "irradiation" insert --dose--.

Column 8, line 54, Claim 3, "thickness" should be --height--.

Column 9, line 19, Claim 9, "amplifying" should be --displaying--;
line 32, Claim 13, "comprisng" should be --comprising--.

Signed and Sealed this

*Thirty-first* Day of *December 1985*

[SEAL]

*Attest:*

DONALD J. QUIGG

*Attesting Officer*

*Commissioner of Patents and Trademarks*